US011065627B2

(12) United States Patent
Kelsey

(10) Patent No.: US 11,065,627 B2
(45) Date of Patent: Jul. 20, 2021

(54) PLANAR MAGNETIC SEPARATOR

(71) Applicant: CYCLOMAG PTY LIMITED, Wollongong (AU)

(72) Inventor: Christopher George Kelsey, Hope Forrest (AU)

(73) Assignee: CYCLOMAG PTY LIMITED, Wollongong (AU)

( * ) Notice: Subject to any disclaimer, the term of this patent is extended or adjusted under 35 U.S.C. 154(b) by 203 days.

(21) Appl. No.: 16/463,028

(22) PCT Filed: Nov. 28, 2017

(86) PCT No.: PCT/AU2017/051306

§ 371 (c)(1),
(2) Date: May 22, 2019

(87) PCT Pub. No.: WO2018/112509

PCT Pub. Date: Jun. 28, 2018

(65) Prior Publication Data

US 2019/0283039 A1 Sep. 19, 2019

(30) Foreign Application Priority Data

Dec. 20, 2016 (AU) ..... 2016905260
Feb. 14, 2017 (AU) ..... 2017900466

(51) Int. Cl.
*B03C 1/24* (2006.01)
*B03C 1/033* (2006.01)
*B03C 1/28* (2006.01)

(52) U.S. Cl.
CPC ..... *B03C 1/24* (2013.01); *B03C 1/0332* (2013.01); *B03C 1/288* (2013.01); *B03C 2201/20* (2013.01)

(58) Field of Classification Search
CPC ..... B03C 1/24; B03C 1/0332; B03C 1/288; B03C 2201/20
USPC ..... 209/39, 215, 217, 222, 232
See application file for complete search history.

(56) References Cited

U.S. PATENT DOCUMENTS 2,826,302 A * 3/1958 Scott ..... B03C 1/22 209/218
4,077,872 A * 3/1978 Glover ..... B03C 1/06 209/214
5,108,587 A * 4/1992 Walker ..... B03C 1/247 209/212
2012/0132593 A1* 5/2012 Murthy ..... C12M 47/10 210/695

FOREIGN PATENT DOCUMENTS

AU 2013234409 4/2014
CA 3044076 A1 * 6/2018 ..... B03C 1/288
(Continued)

*Primary Examiner* — Terrell H Matthews
(74) *Attorney, Agent, or Firm* — Sand, Sebolt & Wernow Co., LPA

(57) ABSTRACT

A separator for extracting magnetic material from an air-stream of magnetic material and non-magnetic material includes a planar chamber with an inlet port, outlet port and a waste port, and a series of magnets in a plane parallel to the chamber. The magnets rotate about a common axis thereby drawing magnetic material around the chamber and towards the outlet port whilst non-magnetic material is remains in the airstream and is discharged by the waste port.

10 Claims, 11 Drawing Sheets

(56) References Cited

FOREIGN PATENT DOCUMENTS

| | | | | | |
|---|---|---|---|---|---|
| CN | 2176186 | | | 9/1994 | |
| GB | 843889 | | | 8/1960 | |
| GB | 879832 | | | 10/1961 | |
| GB | 879832 | A | * | 10/1961 | ..... B03C 1/12 |
| RU | 2170620 | | | 7/2001 | |
| WO | 2016002256 | | | 1/2016 | |
| WO | WO-2018112509 | A1 | * | 6/2018 | ..... B03C 1/0332 |

* cited by examiner

PLANAR MAGNETIC SEPARATOR

FIELD OF THE INVENTION

The present invention relates to mineral processing equipment, in particular a magnetic separator for extracting paramagnetic material such as magnetite from a suspended air stream including unwanted material.

BACKGROUND TO THE INVENTION

The present applicant is also the applicant of various provisional patent applications, namely AU2016900480, AU2016900988, AU2016901408 and AU2016901817, regarding magnetic separators in the form of rotating shells shaped as vertical drums and cones with magnets around the periphery. The devices disclosed in these applications have shown great improvements in magnetic separation techniques, particularly for air suspended particles. However, the geometry of these devices has two limitations. The first limitation is the strength of magnetic field that can be easily produced which has limited operation to highly magnetic and paramagnetic material. The second and most significant limitation is the scalability of the devices. Whilst they can be scaled, in doing so they become large as the magnets used are spread around the periphery of the devices.

The object of this invention is to provide a magnetic separator that can be easily scaled to alleviate the above problem, or at least provide the public with a useful alternative.

SUMMARY OF THE INVENTION

In a first aspect the invention provides a separator for extracting magnetic material from an airstream of magnetic material and non-magnetic material, comprising a planar chamber with an inlet port, outlet port and a waste port, and a series of magnets in a plane parallel to the chamber, whereby the magnets rotate about a common axis thereby drawing magnetic material around the chamber and towards the outlet port whilst non-magnetic material remains in the airstream and is discharged by the waste port.

Preferably chamber further comprises a barrier to stop magnetic material from moving under the influence of the magnets thereby allowing the magnetic material to be extracted from the chamber.

In preference the magnets are arranged in an array with the poles of adjacent magnets antiparallel.

In preference the magnets are arranged in a series of groups of magnets, and wherein the groups of magnets are separated by regions devoid of magnets.

In a further aspect the invention comprises a separator, the separator comprising a plurality of separators described above.

It should be noted that any one of the aspects mentioned above may include any of the features of any of the other aspects mentioned above and may include any of the features of any of the embodiments described below as appropriate.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DRAWING COMPONENTS

Figure 1:
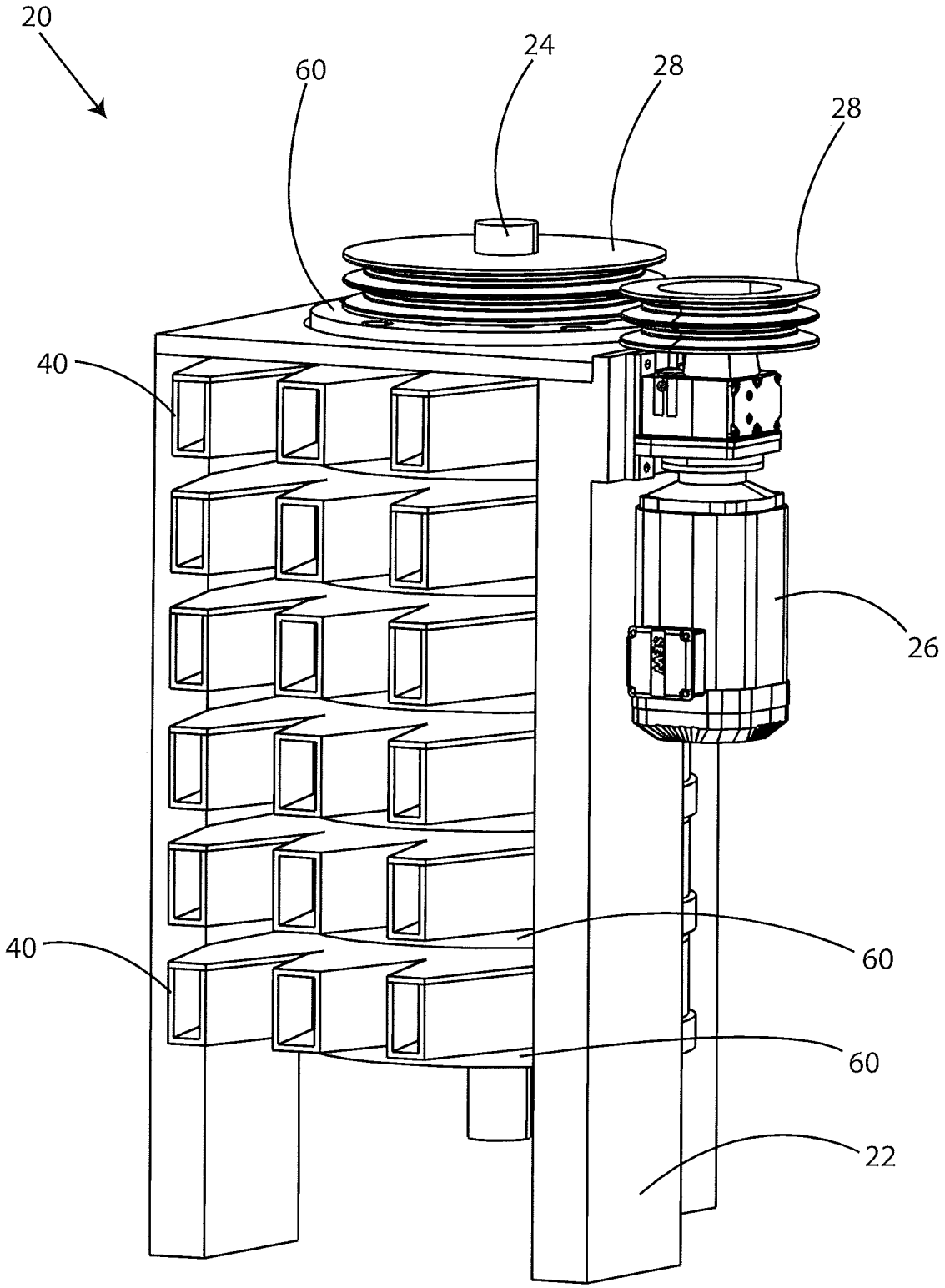
FIG. 1 shows a multi chamber magnetic separator according to a first embodiment of the invention.

The drawings include the following integers.

20 separator (first embodiment)
22 frame
24 common shaft
26 motor
28 drive pulleys
40 separation chamber
41 top
42 bottom
43 semi-circular chamber
44 feed port
45 product port
46 waste port
47 divider
50 bearing
60 magnetic disk (first embodiment)
62 supporting disk
64 magnets
66 discrete yokes
68 planar yoke
71-76 accumulating magnetic material
77 dislodged magnetic material
80 product air stream
200 separator (second embodiment—one chamber)
240 separation chamber
241 top half
242 bottom half
243 semi-circular chamber
244 feed port
245 product port
246 waste port
247 divider
255 disk recess
300 separator (third embodiment—three chambers)
600 magnetic disk (second embodiment)
610 magnetic zone
620 non-magnetic zone
630 entry port

640 divider
650 discharge port
660 waste port

DETAILED DESCRIPTION OF THE INVENTION

The following detailed description of the invention refers to the accompanying drawings. Wherever possible, the same reference numbers will be used throughout the drawings and the following description to refer to the same and like parts. Dimensions of certain parts shown in the drawings may have been modified and/or exaggerated for the purposes of clarity or illustration.

The present invention provides a magnetic separator particularly suited for recovering paramagnetic material such as magnetite from finely crushed ore. The separator comprises a circular planar chamber into which a primary air stream carrying the ore is introduced. A disc above and below the chamber carry a series of magnets and rotate in the direction of the air flow, attracting paramagnetic particles to the floor and roof of the chamber. A wall in the chamber dislodges the collected particles allowing them to be collected by a secondary air stream. An exit for the primary air flow carries non-magnetic particles to waste.

A magnetic separator according to a first embodiment of the present invention is shown as 20 in FIG. 1. The separator 20 comprises a frame 22 with a common shaft 24 supporting a series of separation chambers 40. A magnetic disk 60 according to a first embodiment sits between each chamber 40 and also at the top and bottom of the chamber stack so that each chamber has a magnetic disk above and below it. A motor 26 turns the shaft 24 via drive pulleys 28 (and belt—not shown) and in turn rotates the magnetic disks 60 in unison. Not shown in the figures are feed pipes, blowers etcetera for feeding ore into the separator and removing separated product and waste.

Figure 2:
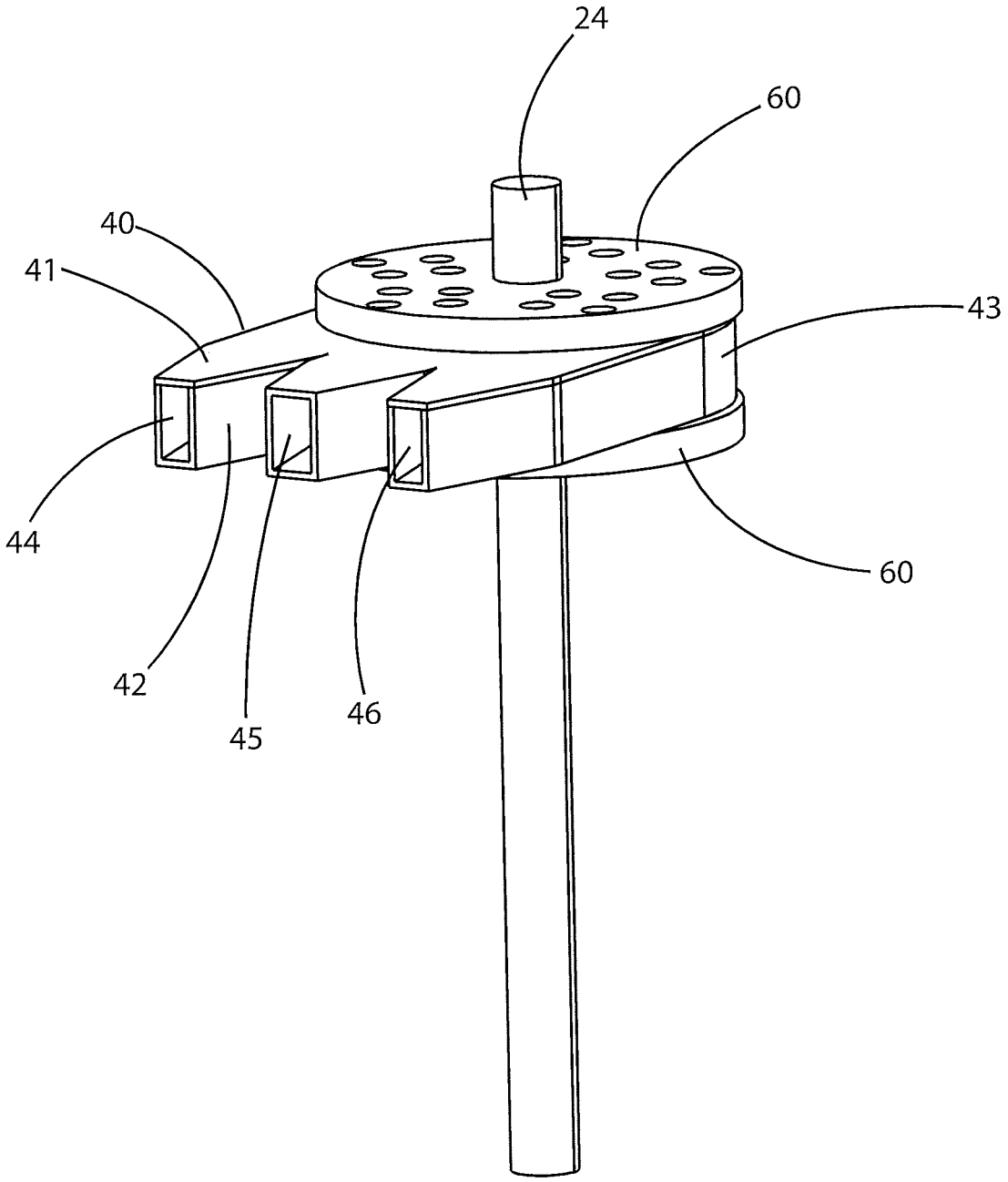
FIG. 2 shows a single chamber of the separator with associated magnetic disks in isolation.
Figure 3:
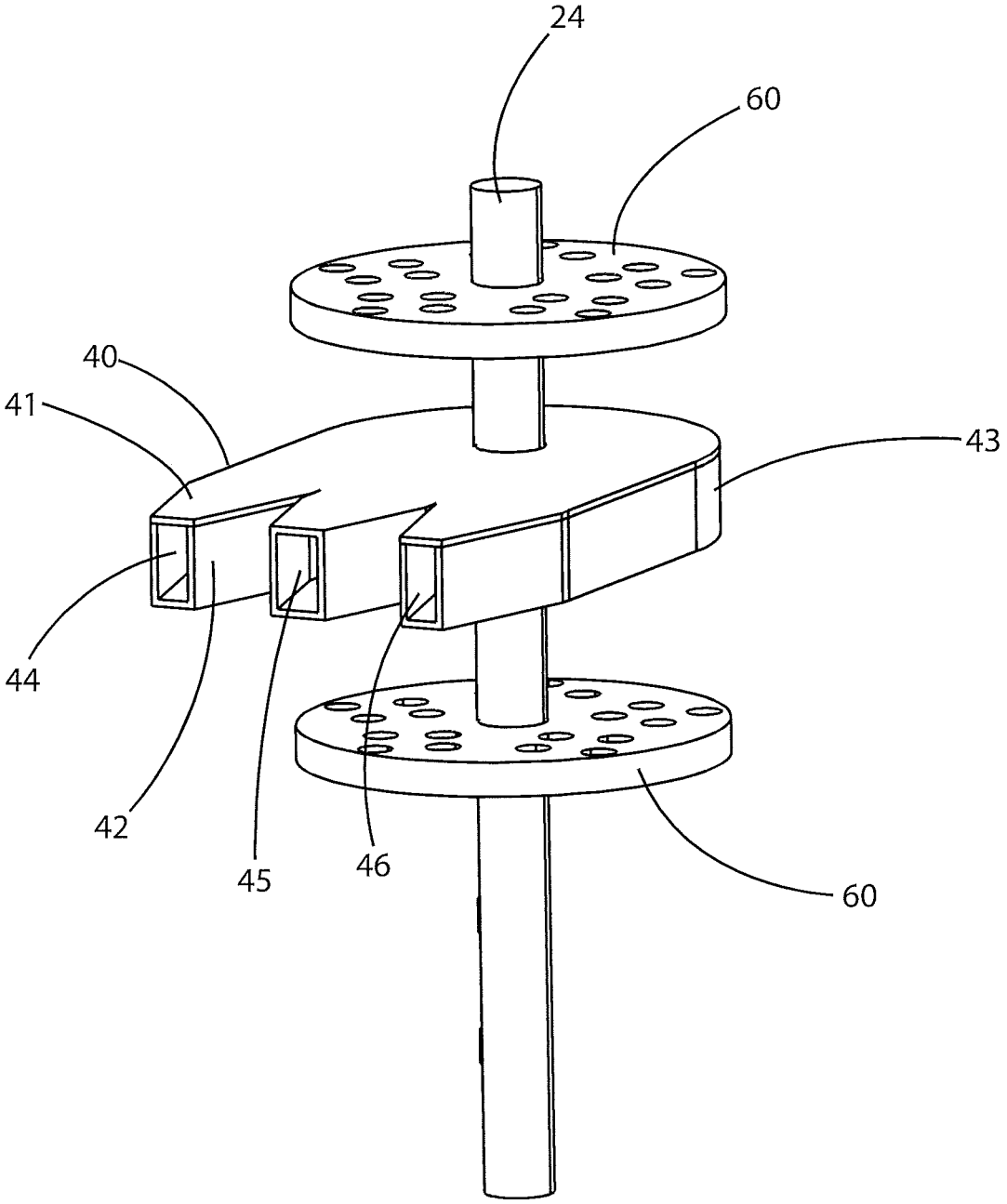
FIG. 3 shows an exploded view of FIG. 2.
Figure 4:
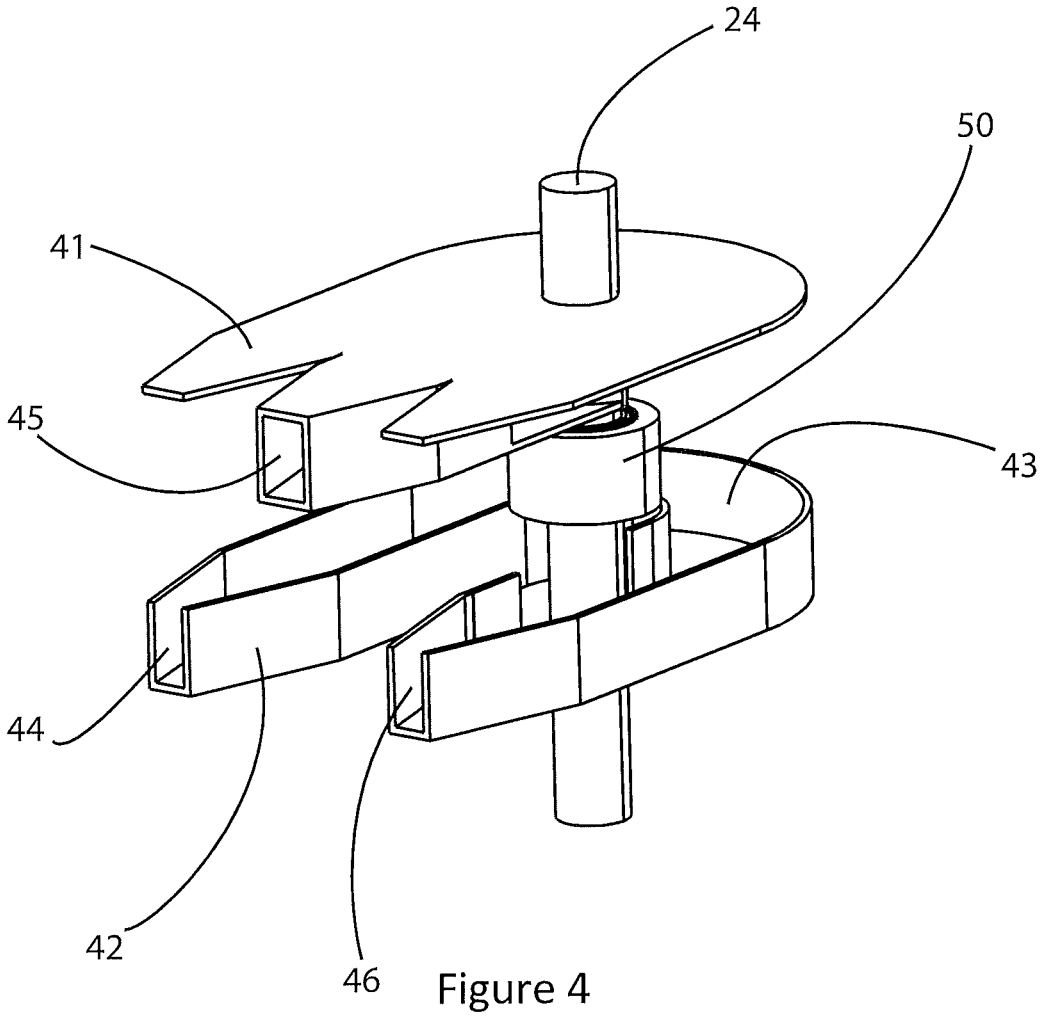
FIG. 4 shows an exploded view of a single chamber.
Figure 5A:
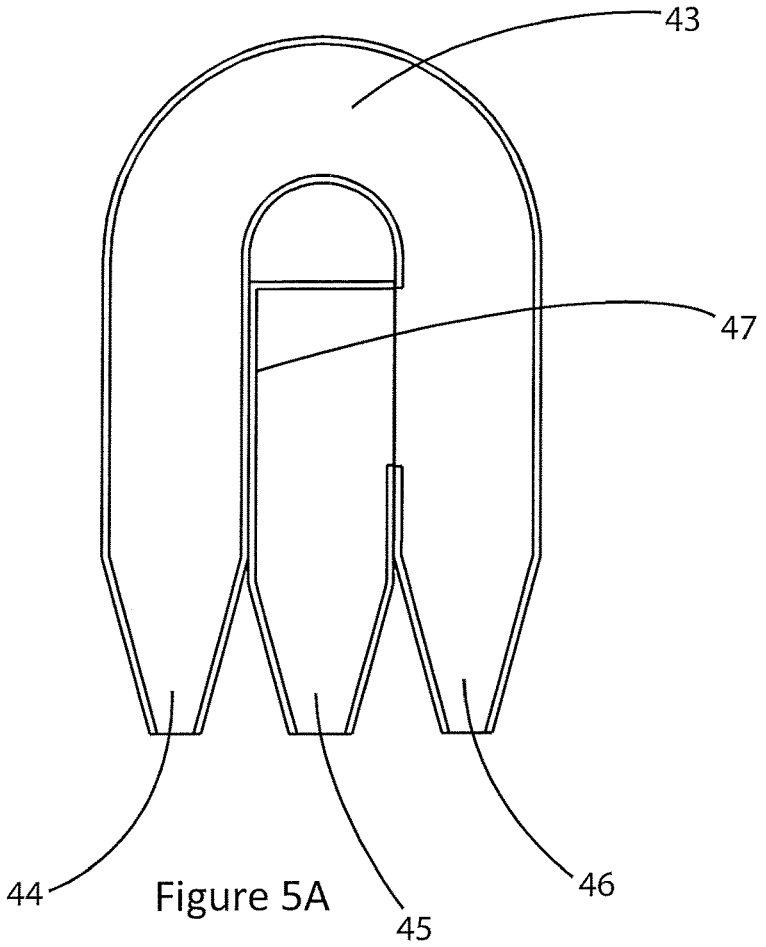
FIGS. 5A and 5B show a cutaway view of a chamber from above and from a perspective view.
Figure 5B:
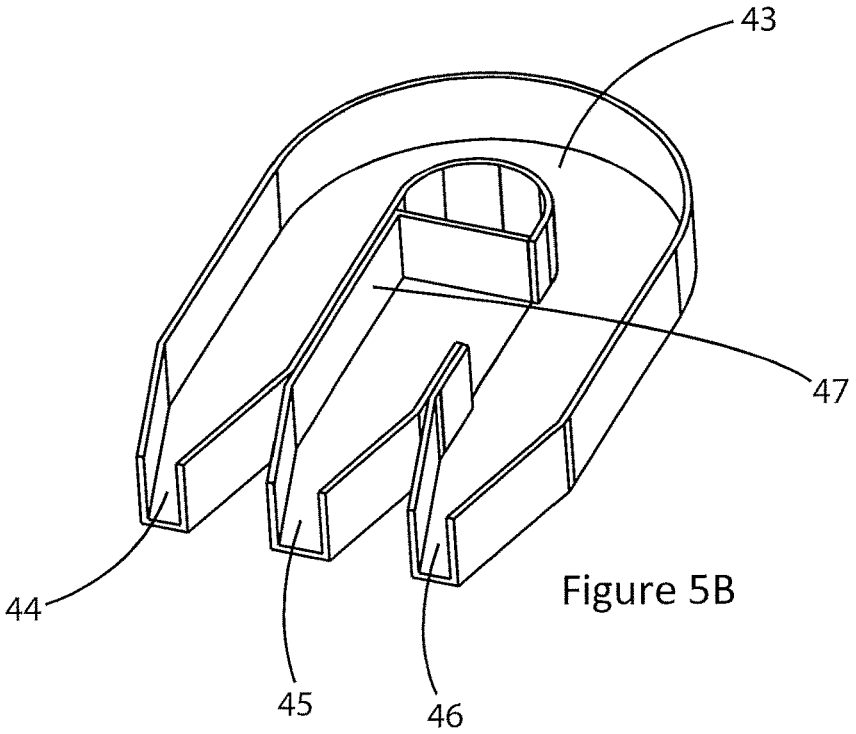

A single separation chamber 40 is shown with associated magnetic disks 60 in FIG. 2. FIG. 3 shows the same in an exploded view whilst FIG. 4 shows the chamber itself in an exploded view. FIGS. 5A and 5B show a cutaway view of a chamber from above and from a perspective view respectively A separation chamber 40 is essentially a short semi-circular chamber with a feed port 44 for the entry of product, a product port 45 through which separated product is extracted, and a waste port 46 for discharging waste material. Material to be separated enters the chamber 40 through entry port 44 suspended in a primary air stream. As the primary air stream moves through the chamber it is subjected to magnetic fields from the associated magnetic disks resulting in magnetic particles being attracted to the top 41 or bottom 42 of the chamber above or below individual magnets 64 of the magnetic disks 60. As the magnetic disks rotate, the separated magnetic particles move in unison with the disks until they contact the divider 47. After the individual magnet has passed the divider the magnetic particles can be drawn out through the product port 45 in a secondary air stream. The non-magnetic particles in the primary air stream move through the chamber unaffected by the magnets and are discharged via the waste port 46. The chamber is made from a non-magnetically susceptible material such as aluminium or plastic.

Figure 6A:
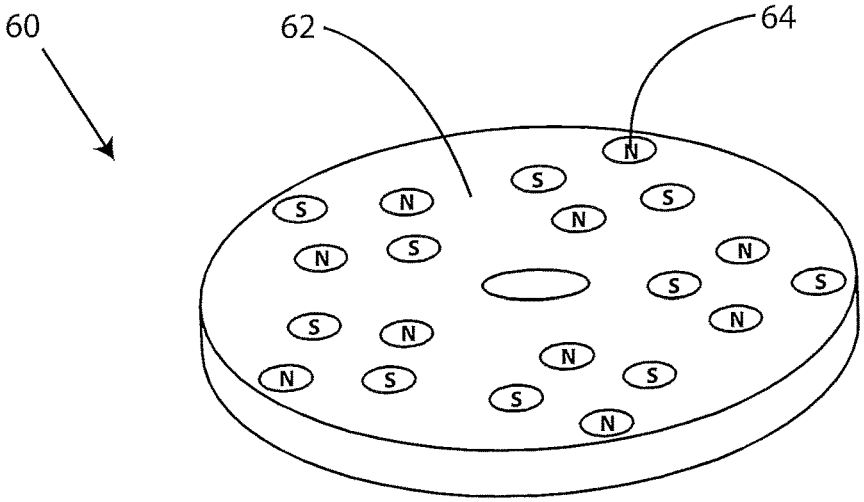
FIG. 6A shows a first embodiment of a magnetic disk of the separator.
Figure 6B:
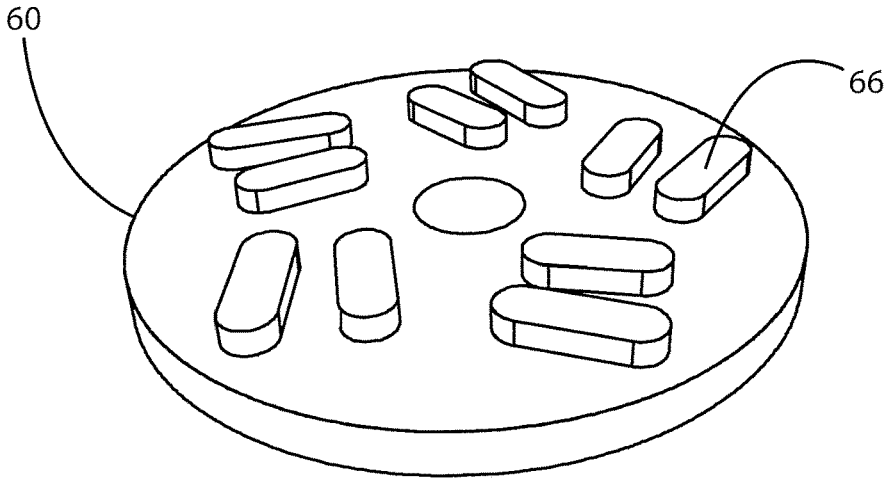
FIG. 6B shows the disk with discrete magnetic yokes fitted.
Figure 6C:
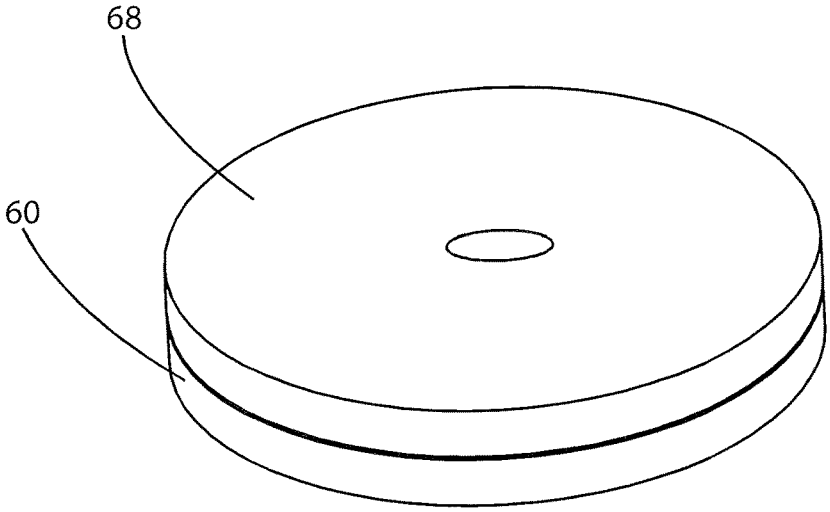
FIG. 6C shows the disk with a planar yoke fitted.

A magnetic disk 60 according to a first embodiment is shown in detail in FIG. 6A. The disk 60 comprises a supporting disk 62 made of non-magnetically susceptible material such as aluminium or plastic with a series of holes holding individual magnets 64. The magnets are arranged such that poles of adjacent magnets are not aligned. This ensures that as magnetic material is separated in the chamber it forms discrete isolated clumps associated with individual magnets instead of a continuous curtain of material which may block airflow through the chamber. To enhance the magnetic field produced within a chamber all magnetic disks in a system are aligned with each other and rotate in unison. The magnetic field produced is further enhanced by the addition of magnetic yokes on the top and bottom magnetic disks of a system. This may be in the form of discrete yokes 66 as shown in FIG. 6B which are attached between a pair of oppositely aligned magnets, or in the form of a planar yoke 68 as shown in FIG. 6C.

Figure 7:
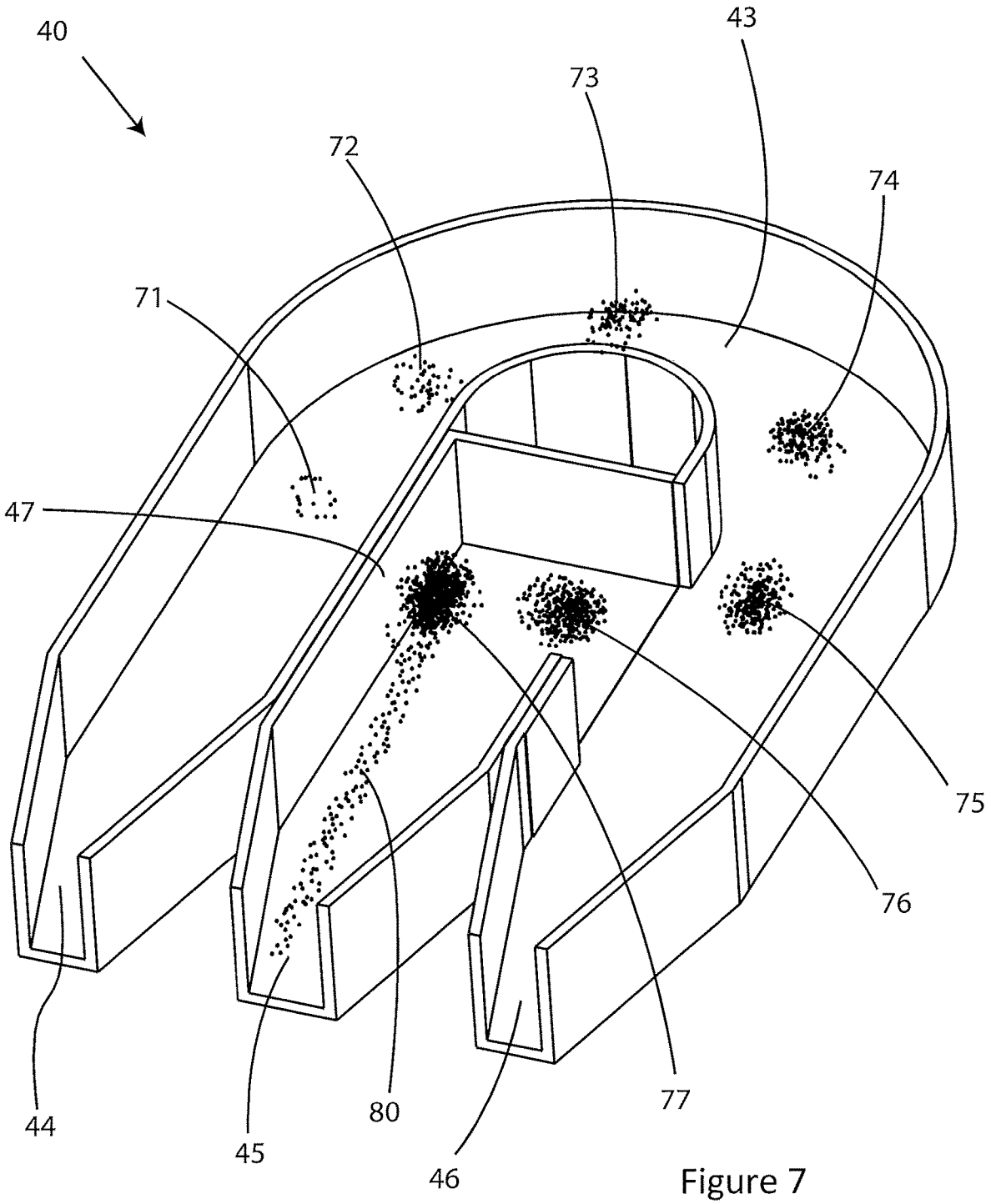
FIG. 7 shows how magnetic material is separated.

The operation of a separation chamber 40 can be appreciated with the aid of FIG. 7 which presents a simplified view of magnetic material being separated in a cutaway chamber. Only the action of a subset of magnets of the magnetic disk below the chamber are shown and discussed. It is to be appreciated that more magnets on the bottom of the chamber as well as the magnets on the top of the chamber would also be in action. Material to be separated (not visible) enters the chamber 40 through entry port 44 suspended in a primary air stream. As the primary air stream moves through the chamber magnetic particles accumulate in clumps 71 to 76 on the bottom of the chamber above individual magnets of the magnetic disk (not shown). As the air stream moves around the chamber the clumps have been in contact with the air stream for longer and hence have attracted more magnetic material. By time the primary air stream reaches the waste port 46 most if not all of the magnetic material has been attracted to a magnet, leaving non-magnetic waste material to discharge. The clumps of magnetic material are drawn around by the rotating magnets until they are dislodged by the dividing wall 47. Dislodged material 77 is then drawn out in a product air stream 80 via product port 45.

Figure 8A:
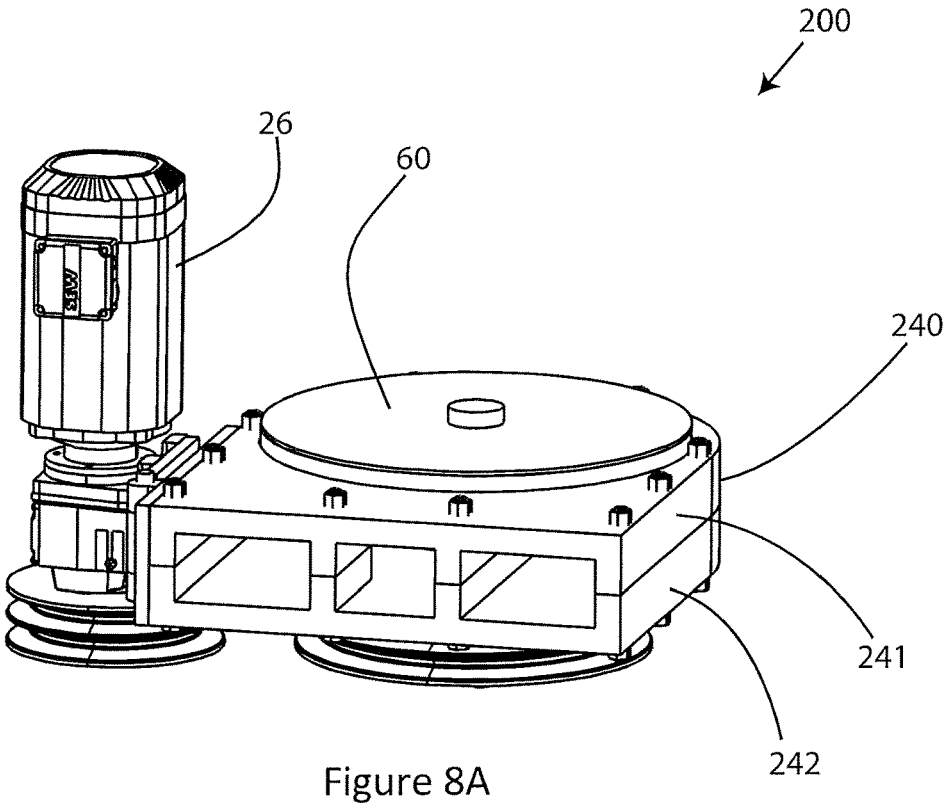
FIG. 8A shows a single chamber separator according to a second embodiment of the invention.
Figure 8B:
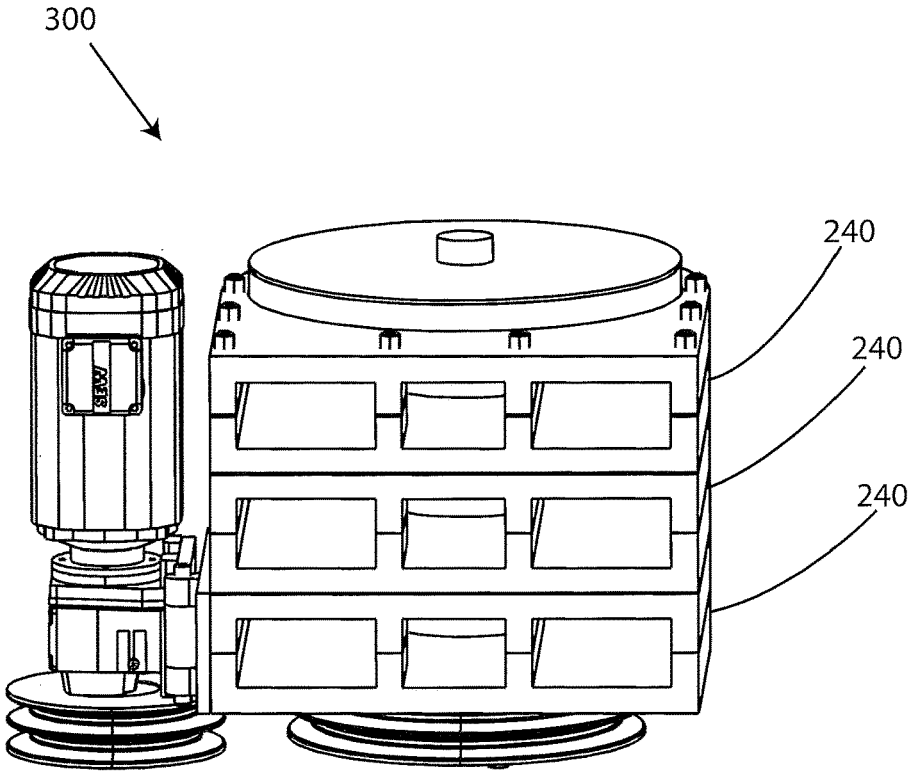
FIG. 8B shows a multi chamber separator according to a third embodiment of the invention.
Figure 9:
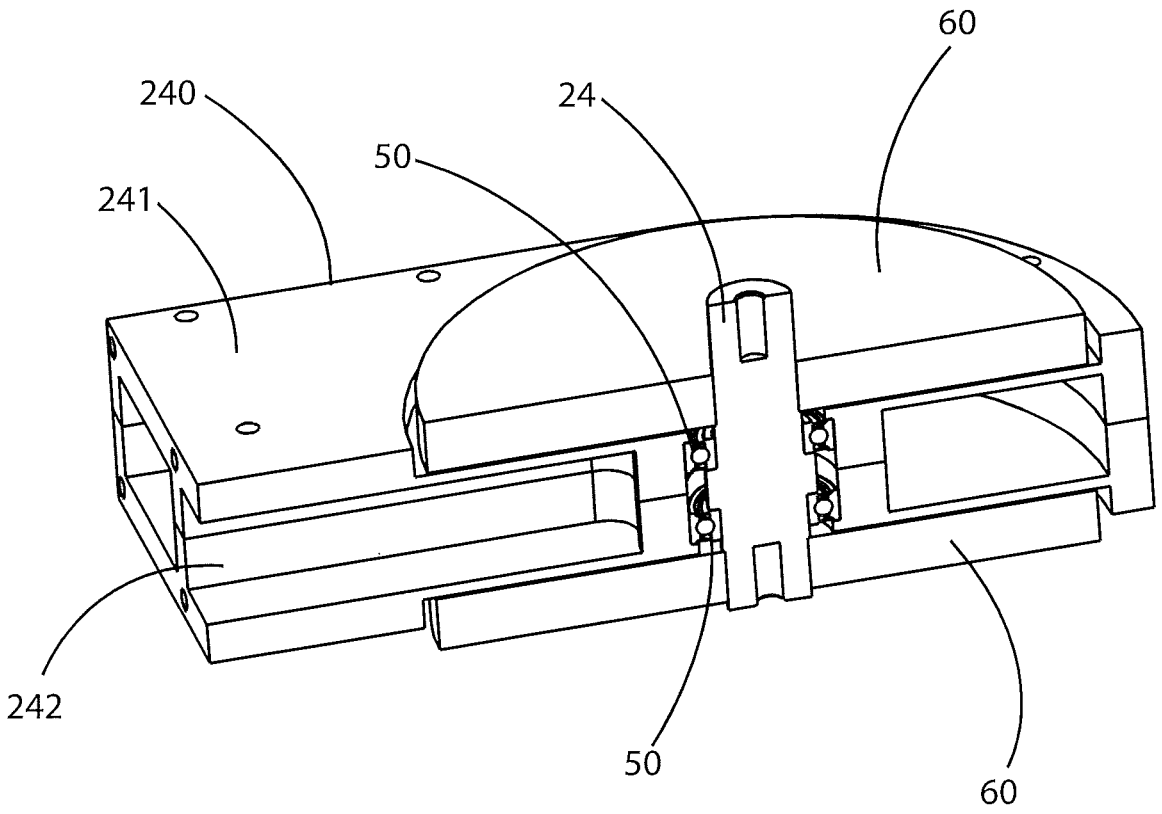
FIG. 9 shows a cross sectional view of a separation chamber according to the second embodiment.

A second embodiment of a separator is shown as 200 in FIG. 8A. In this embodiment a single separation chamber 240 is formed from plastic top half 241 and bottom half 242, into which the magnetic disks 60 are embedded. This configuration allows multiple chambers to be readily stacked as shown in the third embodiment 300 in FIG. 8B. Further details can be appreciated from the cross sectional view of FIG. 9, showing the chamber 240 formed from top 241 and bottom 242 and holding bearings 50 which support the shaft 24 on which the magnetic disks 60 are mounted.

Figure 10A:
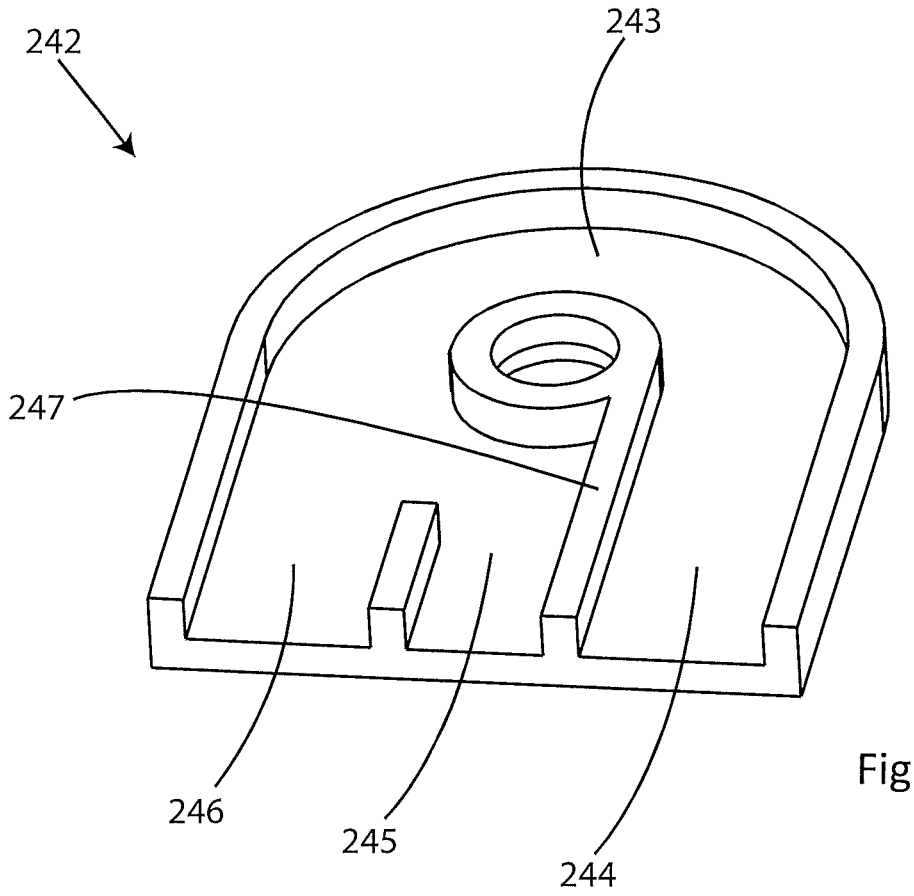
FIGS. 10A and 10B show detail of a bottom half of the separator of FIG. 9 from above and below.
Figure 10B:
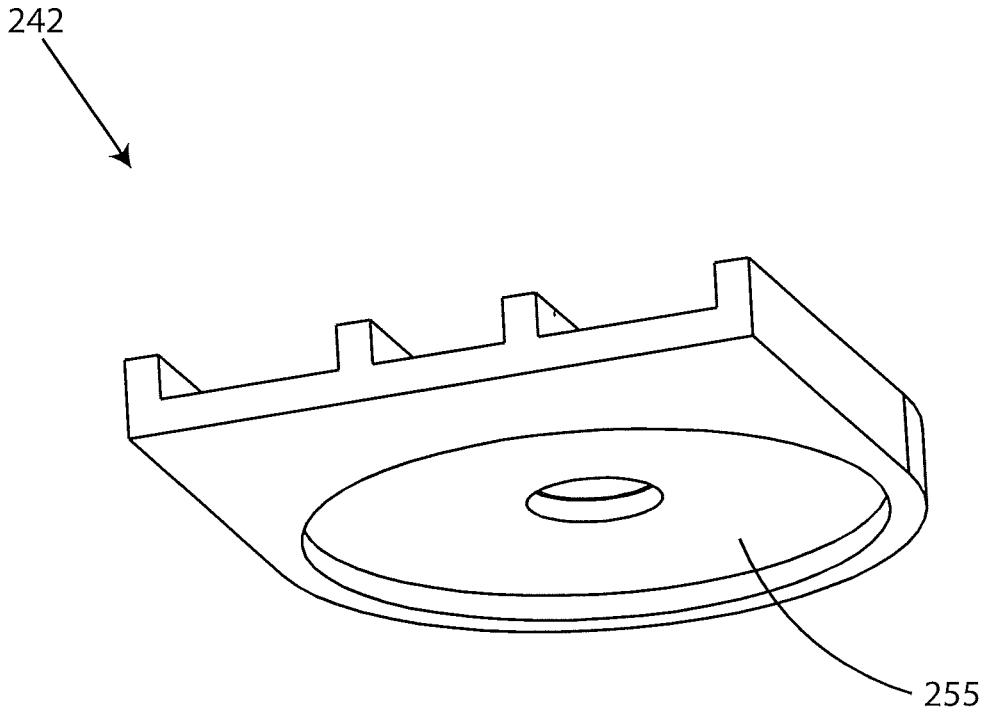

FIGS. 10A and 10B show from above and below respectively the bottom half 242 of the housing 240 in which can be seen feed port 244, product port 245, waste port 246 and divider 247. The corresponding top half 241 (not shown in isolation) is a mirror image of the bottom half. Both halves feature a recess 255 for housing the magnetic disks 60.

Figure 11:
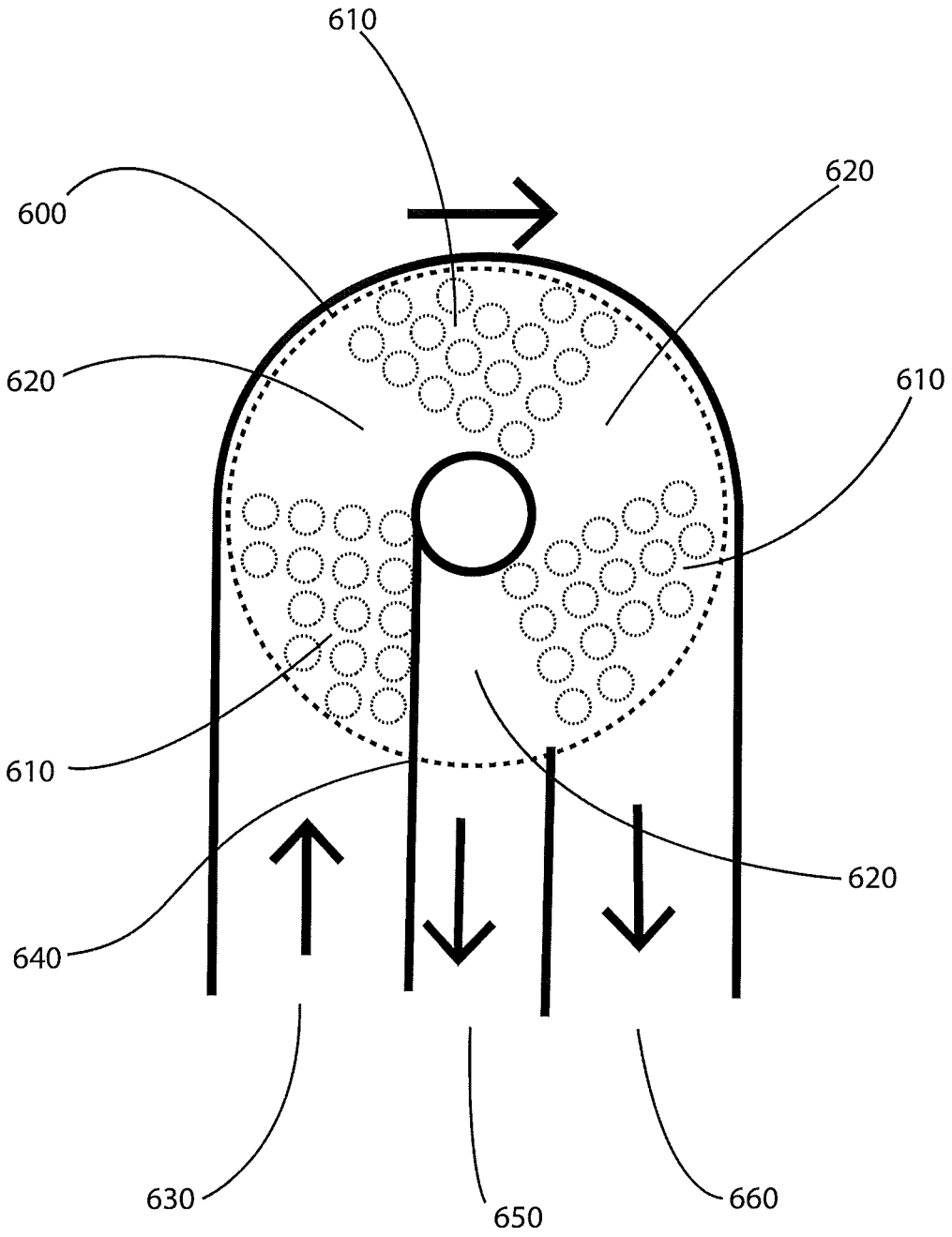
FIG. 11 shows a separator with a magnetic disk according to a second embodiment.

A separator incorporating a second embodiment of the magnetic disk 600 is shown in FIG. 11 in which the magnets are located in a series of groups to form magnetic zones 610 and non-magnetic zones 620. Similar to the magnetic disk 60, the magnetic zones 610 have magnets arranged such that poles of adjacent magnets are not aligned. Magnetic material entering the separator through entry port 630 will be attracted to the magnets in the magnetic zones. As the magnetic disk 610 rotates the attracted magnetic material in the magnetic zone will be dislodged by the divider 640. Once the magnetic zone 610 has passed the divider, the dislodged magnetic material will be sitting in a non-magnetic zone, allowing the dislodged magnetic material to be easily extracted through the discharge port 650 in an airstream. It has been found to be far more efficient and yield a higher grade product when extracting dislodged product from a non-magnetic region. As before the non-magnetic material will exit via the waste port 660.

The embodiments shown are readily scalable by the addition of separation chambers; however the separation chambers can also be scaled by increasing the diameter of the chambers and magnetic disks whilst keeping the chamber height constant. As the magnetic disks are increased in diameter the number of magnets within a disk is also increased.

The reader will now appreciate the present invention which provides a magnetic separator which can be easily scaled in size.

Further advantages and improvements may very well be made to the present invention without deviating from its scope. Although the invention has been shown and described in what is conceived to be the most practical and preferred embodiment, it is recognized that departures may be made therefrom within the scope of the invention, which is not to be limited to the details disclosed herein but is to be accorded the full scope of the claims so as to embrace any and all equivalent devices and apparatus. Any discussion of the prior art throughout the specification should in no way be considered as an admission that such prior art is widely known or forms part of the common general knowledge in this field.

In the present specification and claims (if any), the word "comprising" and its derivatives including "comprises" and "comprise" include each of the stated integers but does not exclude the inclusion of one or more further integers.

The invention claimed is:

1. A separator for extracting magnetic material from an airstream of magnetic material and non-magnetic material, comprising a planar chamber with an inlet port, outlet port and a waste port, and a series of magnets in planes parallel to and on both sides of the chamber, the magnets rotating about a common axis thereby drawing magnetic material around the chamber and towards the outlet port whilst non-magnetic material remains in the airstream and is discharged by the waste port, whereby the magnets on both sides of the chamber are aligned with each another and rotate in unison.

2. The separator as in claim 1, wherein the chamber further comprises a barrier to stop magnetic material from moving under the influence of the magnets thereby allowing the magnetic material to be extracted from the chamber.

3. A separator for extracting magnetic material from an airstream of magnetic material and non-magnetic material, comprising a planar chamber with an inlet port, outlet port and a waste port, and a series of magnets in a plane parallel to the chamber, whereby the magnets rotate about a common axis thereby drawing magnetic material around the chamber and towards the outlet port whilst non-magnetic material remains in the airstream and is discharged by the waste port; and wherein the magnets are arranged in an array with the poles of adjacent magnets antiparallel.

4. The separator as in claim 1, wherein the magnets are arranged in a series of groups of magnets, and wherein the groups of magnets are separated by regions devoid of magnets.

5. A separator for extracting magnetic material from an airstream of magnetic material and non-magnetic material comprising a plurality of separators, each having a planar chamber with an inlet port, outlet port and a waste port, and a series of magnets in a plane parallel to the chamber, whereby the magnets rotate about a common axis thereby drawing magnetic material around the chamber and towards the outlet port whilst non-magnetic material remains in the airstream and is discharged by the waste port.

6. The separator as in claim 3, wherein the chamber further comprises a barrier to stop magnetic material from moving under the influence of the magnets thereby allowing the magnetic material to be extracted from the chamber.

7. The separator as in claim 3, wherein the magnets are arranged in a series of groups of magnets, and wherein the groups of magnets are separated by regions devoid of magnets.

8. The separator as in claim 1, wherein the magnets are arranged in an array with poles of adjacent magnets antiparallel.

9. A separator for magnetic material comprising a plurality of separators according to claim 1.

10. The separator as in claim 1, wherein the magnets rotate in the same direction as the airstream through the chamber.

* * * * *